US008931589B2

(12) United States Patent
Bothien et al.

(10) Patent No.: US 8,931,589 B2
(45) Date of Patent: Jan. 13, 2015

(54) DAMPER ARRANGEMENT AND METHOD FOR DESIGNING SAME

(75) Inventors: Mirko Bothien, Zürich (CH); Bruno Schuermans, La Tour de Peilz (CH); Nicolas Noiray, Bern (CH); Andreas Huber, Baden (CH); Adrian Glauser, Umiken (CH)

(73) Assignee: Alstom Technology Ltd., Baden (CH)

( * ) Notice: Subject to any disclaimer, the term of this patent is extended or adjusted under 35 U.S.C. 154(b) by 30 days.

(21) Appl. No.: 13/152,499

(22) Filed: Jun. 3, 2011

(65) Prior Publication Data

US 2011/0308654 A1 Dec. 22, 2011

(30) Foreign Application Priority Data

Jun. 16, 2010 (EP) ..... 10166140

(51) Int. Cl.
*F01N 13/02* (2010.01)

(52) U.S. Cl.
CPC .... *F23M 99/005* (2013.01); *F23R 2900/00014* (2013.01)
USPC ..... 181/241; 181/219; 181/277

(58) Field of Classification Search
USPC ..... 181/219, 241, 250, 266, 271, 273, 276, 181/277, 278; 60/725
See application file for complete search history.

(56) References Cited

U.S. PATENT DOCUMENTS

| | | | | |
|---|---|---|---|---|
| 5,475,189 | A * | 12/1995 | Field et al. | 181/241 |
| 5,489,753 | A * | 2/1996 | Gibel | 181/230 |
| 7,337,877 | B2 * | 3/2008 | Goenka et al. | 181/250 |
| 2002/0100281 | A1 | 8/2002 | Hellat et al. | |
| 2005/0223707 | A1 * | 10/2005 | Ikeda et al. | 60/725 |
| 2006/0059913 | A1 | 3/2006 | Bethke et al. | |
| 2008/0066999 | A1 * | 3/2008 | Kostun et al. | 181/250 |

FOREIGN PATENT DOCUMENTS

| | | |
|---|---|---|
| DE | 102005062284 | 1/2008 |
| EP | 0111336 | 6/1984 |
| EP | 1010939 | 6/2000 |
| EP | 1158247 | 11/2001 |
| EP | 1568869 | 8/2005 |
| EP | 1624251 | 2/2006 |
| WO | WO95/11373 | 4/1995 |
| WO | WO2005/059441 | 6/2005 |

OTHER PUBLICATIONS

Translation of DE 102005062284 A1, accessed Nov. 27, 2012.*
European Search Report for EP Patent App. No. 10166140.3 (Jan. 17, 2011).

(Continued)

*Primary Examiner* — Jeremy Luks
(74) *Attorney, Agent, or Firm* — Buchanan Ingersoll & Rooney PC

(57) ABSTRACT

A damper arrangement (10) has a first Helmholtz damper (11) connected in series to a second Helmholtz damper (12). The resonance frequency of the first Helmholtz damper (11) and the resonance frequency of the second Helmholtz damper (12) are shifted from one another in an amount producing a synergic damping effect.

14 Claims, 4 Drawing Sheets

(56) References Cited

OTHER PUBLICATIONS

Office Action from European Patent App. No. 10166140.3 (Mar. 6, 2013).

Valter Belucci, "Modeling and Control of Gas Turbine Thermoacoustic Pulsations" Dissertation, Berlin, Apr. 23, 2009, pp. 92-93.

* cited by examiner

DAMPER ARRANGEMENT AND METHOD FOR DESIGNING SAME

This application claims priority under 35 U.S.C. §119 to European App. No. 10166140.3, filed 16 Jun. 2010, the entirety of which is incorporated by reference herein.

BACKGROUND

1. Field of Endeavor

The present invention relates to a damper arrangement and a method for designing same.

In particular, in the following reference to a damper arrangement having two or more Helmholtz dampers, connected in series and used to damp pressure oscillations or pulsations that may generate in a combustion chamber of a gas turbine, is made.

2. Brief Description of the Related Art

Gas turbines are known to have one or more combustion chambers, wherein a fuel is injected, mixed to an air flow and combusted, to generate high pressure flue gases that are expanded in a turbine.

During operation, pressure oscillations may generate that could cause mechanical and thermal damage to the combustion chamber and limit the operating regime.

For this reason, usually combustion chambers are provided with damping devices, such as quarter wave tubes, Helmholtz dampers or acoustic screens, to damp these pressure oscillations.

With reference to FIG. 1, traditional Helmholtz dampers 1 include an enclosure 2, that defines a resonator volume 3, and a neck 4 to be connected to a combustion chamber 5, wherein combustion and possibly pressure oscillations to be damped occur (reference 6 indicates the wall of the combustion chamber 5).

The resonance frequency (i.e., the damped frequency) of the Helmholtz damper depends on the geometrical features of the resonator volume 3 and neck 4 and must correspond to the frequency of the pressure oscillations generated in the combustion chamber 5.

In order to address pressure oscillations having different frequencies, two or more Helmholtz dampers are used.

For example, DE 10 2005 062 284 discloses a damper arrangement having two or also more than two Helmholtz dampers connected in series, i.e., the neck of a Helmholtz damper is connected to the volume of another Helmholtz damper. This arrangement proved to be quite efficient in damping pressure oscillation having different, far apart frequencies, such as for example 15 Hz and 90 Hz.

Nevertheless, frequency pressure oscillations may slightly change from gas turbine to gas turbine and, in addition, also for the same gas turbine it may slightly change during gas turbine operation (for example part load, base load, transition).

Since at the low frequency range (where Helmholtz dampers are often used) the damping frequency bandwidth of the Helmholtz dampers is very narrow, such frequency shifting of the pressure oscillations generated in a combustion chamber could render a Helmholtz damper connected to it and having a prefixed design resonance frequency completely useless.

In these cases, traditionally systems for tuning of the resonance frequency are used.

For example, Helmholtz dampers have been developed having an adjustable volume.

WO 2005/059441 discloses a Helmholtz damper having two cup-shaped tubular bodies mounted in a telescopic way.

EP 1158247 discloses a Helmholtz damper whose resonance volume houses a flexible hollow element whose size may be changed by injecting or blowing off a gas; changing the size of the flexible hollow element allows the size of the resonance volume to be changed.

U.S. Patent Application Pub. No. 2005/0103018 discloses a Helmholtz damper whose resonance volume is divided into a fixed and a variable damping volume. The variable volume may be regulated by an adjustable piston.

Alternatively, tuning of the resonance frequency is achieved by adjusting the neck of the Helmholtz dampers.

In this respect, EP 0724684 discloses a Helmholtz damper in which the cross section of the neck may be adjusted.

EP 1624251 discloses a Helmholtz damper with a neck whose length may be adjusted by overlapping a holed plate to its mouth.

All these solutions proved to be quite complex and, in addition, they do not allow a fine tuning of the resonance frequency of the Helmholtz damper, to follow small shifting of the frequency pressure oscillations in the combustion chamber.

SUMMARY

One of numerous aspects of the present invention therefore includes a damper arrangement and a method for designing same addressing the aforementioned problems of the known art.

Another aspect of the invention includes a damper arrangement and a method for designing same that permit damping of pressure oscillations in a large damping bandwidth, in particular when compared to the bandwidth of traditional damp arrangements made of Helmholtz dampers.

A further aspect of the invention includes a damper arrangement that is able to cope with the frequency shifting of the pressure oscillations with no or limited need of fine tuning.

Another aspect includes a damper arrangement that is very simple, in particular when compared to the traditional damper arrangements described above.

BRIEF DESCRIPTION OF THE DRAWINGS

Further characteristics and advantages of the invention will be more apparent from the description of a preferred but non-exclusive embodiment of the damper arrangement and method, illustrated by way of non-limiting example in the accompanying drawings, in which.

DETAILED DESCRIPTION OF EXEMPLARY EMBODIMENTS

Figure 1:
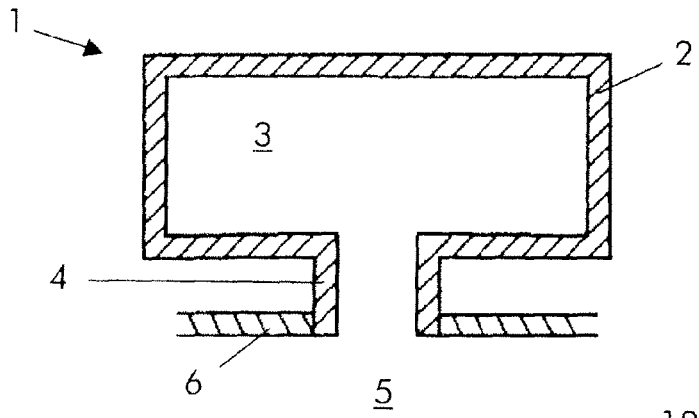
Fig. 1 PRIOR ART
FIG. 1 is a schematic view of a traditional Helmholtz damper.

With reference to FIGS. 2-10, a damper arrangement 10 having a first Helmholtz damper 11 connected in series to a second Helmholtz damper 12 is illustrated.

The resonance frequency of the first Helmholtz damper 11 and the resonance frequency of the second Helmholtz damper 12 are close or very close to one another and, in particular, they are shifted from one another in an amount producing a synergic damping effect.

The resonance frequencies of the Helmholtz dampers are close one another if the following relation is satisfied:

$$CL=(\omega_1-\omega_2)^2/(\omega_1\cdot\omega_2)\leq 1$$

In particular, very close means that CL<<1, wherein CL<<1 means at least one order of magnitude lower than 1.

The second Helmholtz damper 12 has a second volume 13 and a second neck 14 connectable to the inside of a chamber 15 wherein pressure oscillations to be damped may occur (for example a combustion chamber of a gas turbine), and the first Helmholtz damper 11 has a first damping volume 16 and a first neck 17 connected to the second volume 13.

Advantageously the first volume 16 and/or the second volume 13 are variable volumes.

In particular, as shown in the figures, one cylinder 20 housing a slidable piston 21 defines the first volume 16 at a side of the piston 21 and the second volume 13 at the other side of the piston 21; the piston 21 also defines the first neck 17; as shown in the figures, the first neck 17 is defined by holes in the piston 21.

Figure 2:
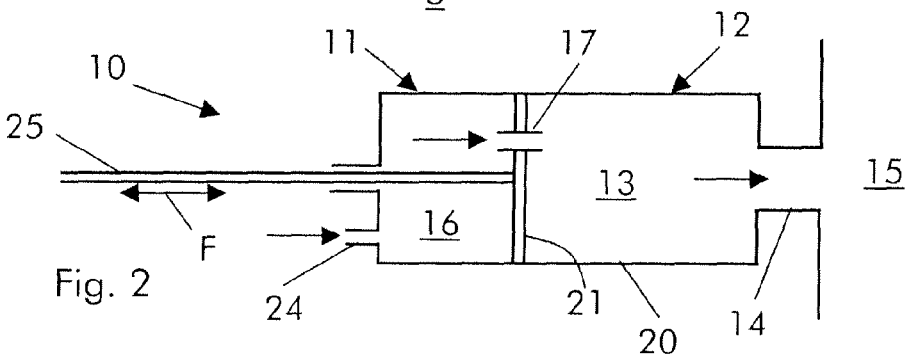
FIGS. 2 through 4 show different arrangements of Helmholtz dampers in different embodiments of the invention.
Figure 3:
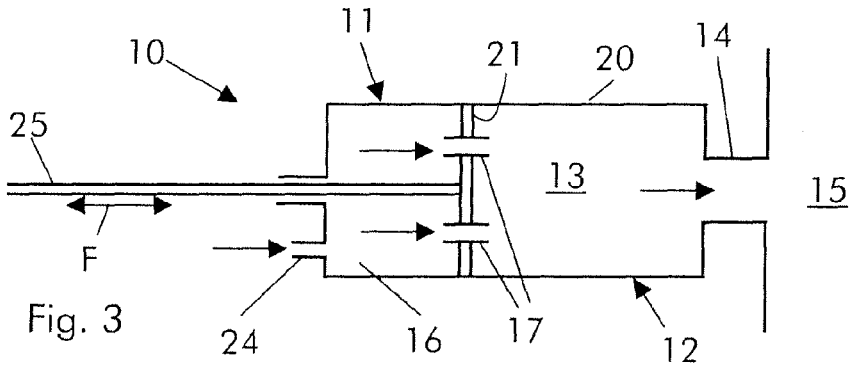
Figure 4:
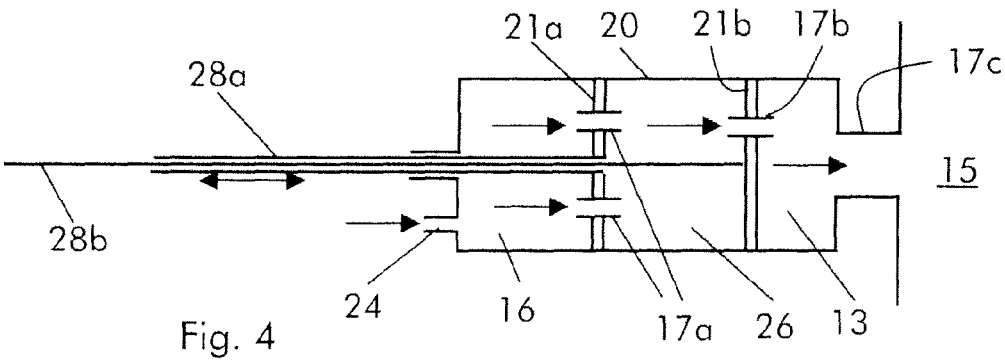

FIGS. 2-4 show different embodiments adhering to principles of the present invention.

FIG. 2 shows an embodiment in which the cylinder 20 defines with the piston 21 two volumes. In this embodiment also an entrance 24 for cooling air is shown.

In addition the piston is provided with a rod 25 connected to the piston 21 to move it and regulate its position as shown by arrow F; this regulation allows the volumes 16 and 13 to be regulated.

FIG. 3 shows an embodiment similar to the one of FIG. 2; in FIG. 3, the same reference numerals indicate the same or similar components as in FIG. 2.

In particular, the embodiment of FIG. 3 has four first necks 17 in the piston 21 (only two necks are shown); naturally also a different number of necks may be used.

FIG. 4 shows a further embodiment, similar to the one of FIGS. 2 and 3 and in which same reference numerals indicate the same or similar components.

In particular, the arrangement of FIG. 4 has a cylinder 20 with two pistons; a first piston 21*a* defines the first and an intermediate volume 16, 26 and has four first necks 17*a* (only two necks are shown), and a second piston 21*b* defines the second volume 13 and the intermediate volume 26 and has one intermediate neck 17*b*. Thus the intermediate volume 26 is defined between the first and the second pistons 17*a*, 17*b* and the second volume 13 is connected to the inner of the chamber 15 via the second neck 17*c*.

In this embodiment each of the pistons 21*a*, 21*b* is connected to a rod 28*a*, 28*b* (for example a hollow rod 28*a* connected to the piston 21*a* houses a second rod 28*b* connected to the piston 21*b*).

This allows regulation of the position of both pistons 21*a*, 21*b* independently from one another and, thus, regulation of the volumes 16, 26, 13.

Figure 5:
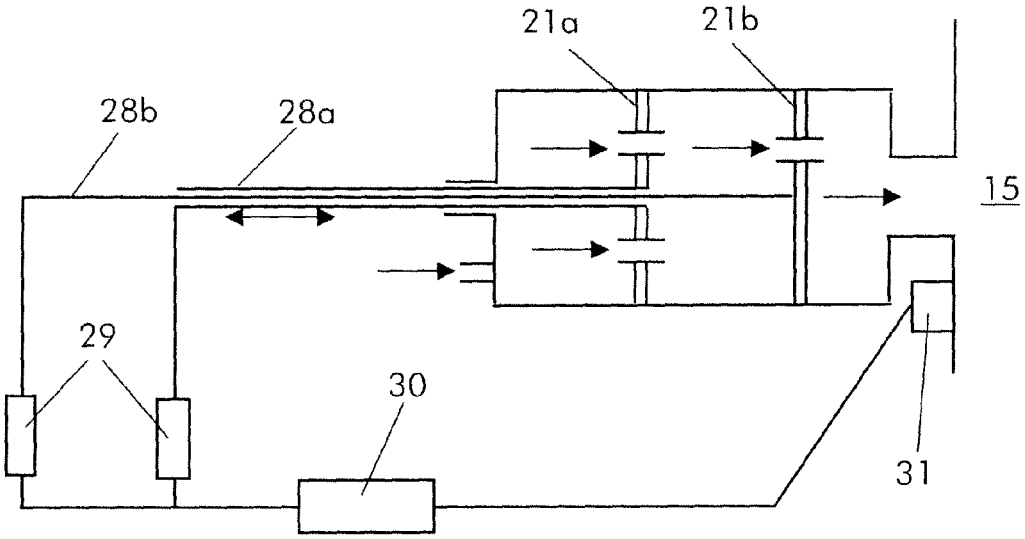
FIG. 5 shows a further arrangement of Helmholtz dampers useful for test operations.

FIG. 5 shows a further embodiment.

This embodiment is similar to the one of FIG. 4 and the same reference numerals identify the same or similar components.

In addition, in the embodiment of the FIG. 5 each of the rods 28*a*, 28*b* is connected to an actuator 29 to adjust its position. The actuators are connected to and driven by a control unit 30 connected to pressure pulsation sensors 31.

Advantageously, the necks 17 and/or 17*a* and/or 17*b* may have a variable cross section.

Figure 6:
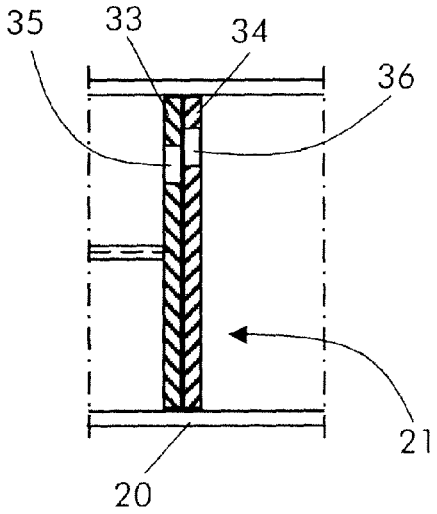
FIGS. 6 and 7 show a particular of a piston inserted into a cylinder to define the volumes of the Helmholtz dampers, this piston is able to tune the size of the neck connecting the dampers in order to adjust acoustic coupling between the volumes for better performances.
Figure 7:
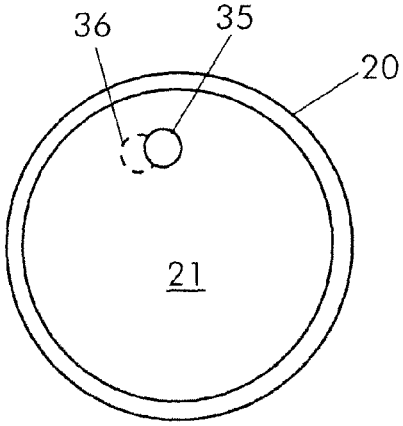

In this respect, FIGS. 6 and 7 show an example of a piston 21 having two pieces 33, 34 slidable one over the other and each provided with alignable holes 35, 36; i.e., the pieces 33, 34 may rotate such that the holes 35, 36 are at least partially aligned. The neck 17 with variable cross section is defined by the aligned holes 35, 36 of the pieces 33, 34.

The arrangement shown in FIG. 5 is particularly adapted for testing operation.

In this case, while the device having the chamber 15, wherein pressure oscillations may generate, is operated, the sensors 31 detect the pressure oscillations generated in the combustion chamber 15 and transmit a signal indicative thereof to the control unit 30; the control unit 30 activates the actuators 29 to regulate the positions of the pistons 21*a*, 21*b* until the pressure oscillations are damped in a broad bandwidth.

In this respect, the control unit 30 and the actuators 29 drive the pistons 21*a*, 21*b* such that the resonance frequencies of the Helmholtz dampers defining the arrangement (i.e., Helmholtz dampers defined respectively by volume 13 and neck 17*c*; volume 26 and neck 17*b*; volume 16 and necks 17*a*) are very close one to the other in an amount producing a synergic damping effect.

Naturally, an actuator 29, a control unit 30 and sensors 31 may also be connected to the arrangements shown in FIGS. 2 through 4; in this case only the position of the single piston 21 is to be regulated.

Afterwards (i.e., when the particular configuration allowing larger bandwidth is achieved) the piston 21 or pistons 21*a*, 21*b* may be welded to the cylinder 20 to manufacture the arrangement 10.

The present invention also relates to methods for designing a damper arrangement.

Exemplary methods include providing at least a first Helmholtz damper 11 connected in series to a second Helmholtz damper 12 and shifting the resonance frequency of the first Helmholtz damper 11 and the resonance frequency of the second Helmholtz damper 12, one with respect to the another, until a displacement producing a synergic damping effect is found.

In particular, the resonance frequencies of the Helmholtz dampers of the arrangement are shifted one towards the other, to find a small displacement producing the synergic damping effect.

Shifting is achieved by regulating the first and/or second volume 16, 13 and/or regulating the cross section of the first neck, to regulate the flow velocity through the first neck. By an appropriate adjustment of the flow velocity inside the neck the broadband character can be adjusted.

The broadband character of the damping device depends on the non-dimensional value q, which is defined as $$q=(\omega_0\cdot L_N)/(\zeta\cdot u_N)$$

For the example of a damper having two volumes, $\omega_0$ is the arithmetic mean of the single frequencies of the single dampers, $L_N$ is the length of the intermediate neck, $\zeta$ is the loss coefficient of the intermediate neck, and $u_N$ is the flow velocity inside the intermediate neck.

Figure 10:
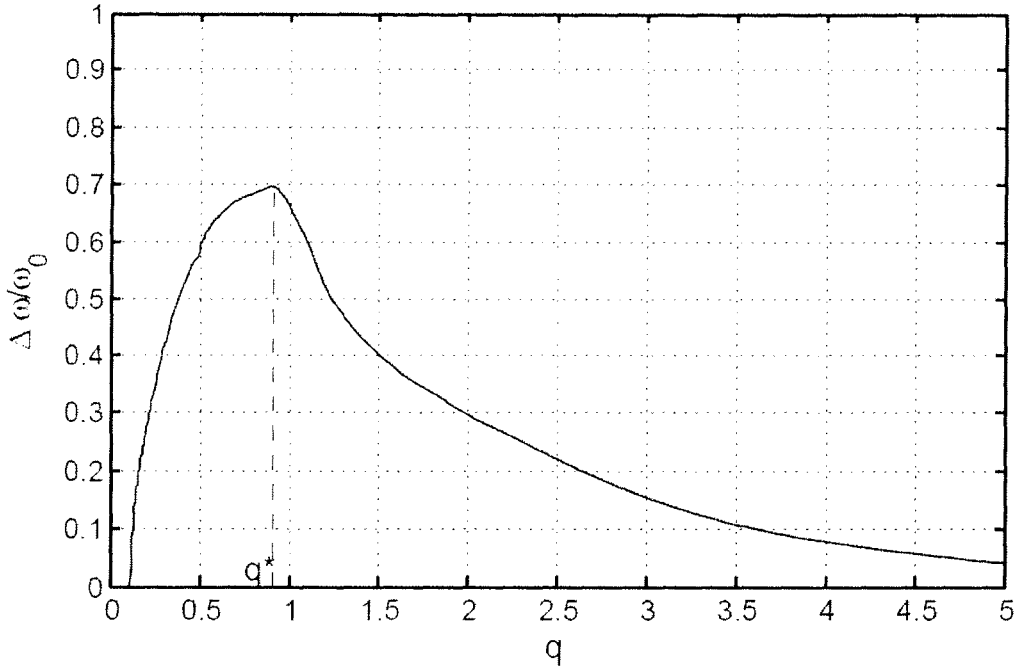
FIG. 10 shows the normalized frequency as a function of the non-dimensional number q.

FIG. 10 shows the normalized frequency bandwidth for effective damping as a function of the q-factor. The damper arrangement has the largest broadband at q*, where the governing parameters are adjusted to their optimum values.

Tests showed that the arrangements in the embodiments described herein have a synergic damping effect that allows a large damping bandwidth to be achieved.

Figure 8:
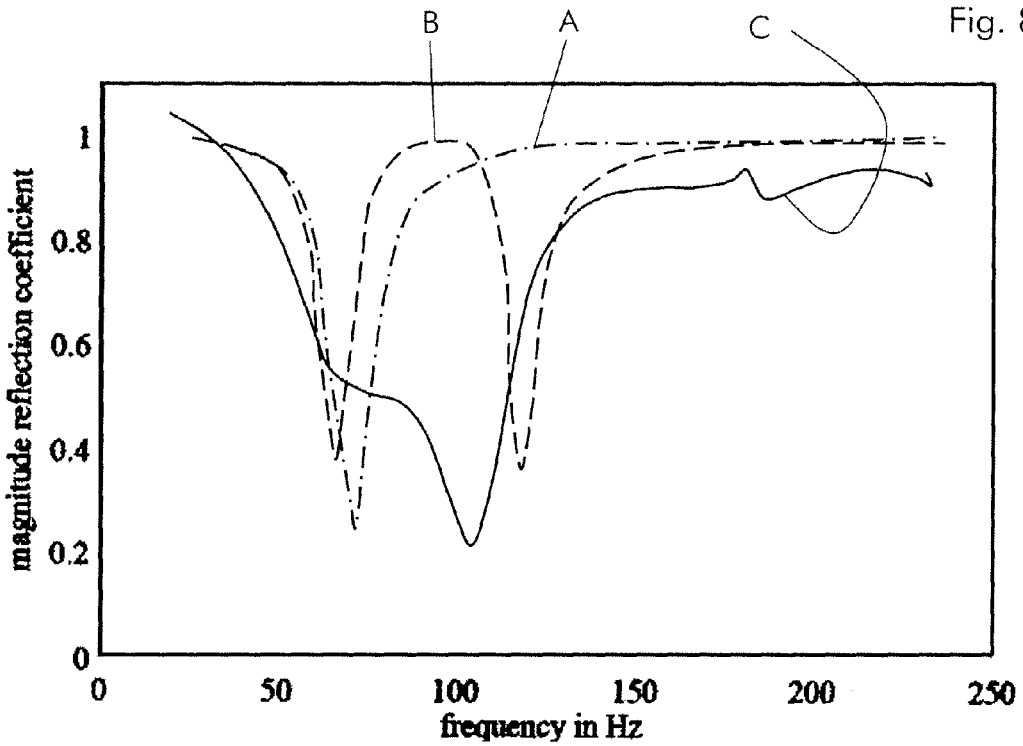
FIGS. 8 and 9 shows the magnitude of the reflection coefficient of different Helmholtz damper arrangements.

FIG. 8 shows a diagram indicating the magnitude of the reflection coefficient of different Helmholtz dampers.

The diagram was drawn providing a pipe closed at one end by a wall perpendicular to the pipe's axis. Then a damper arrangement was connected to the wall and at the other end (i.e., at the open end of the pipe) a source of pressure oscillations was provided (for example, a loudspeaker).

Thus pressure oscillations were generated and directed towards the wall. When impinging on the wall the pressure oscillations were partly damped (by the damping arrangement) and partly reflected. The larger the reflected pressure oscillations, the worse the damping efficiency of the damper arrangement, therefore values of the magnitude reflection coefficient close to 1 in the diagram of FIG. 8 indicate poor damping effect, whereas smaller values (i.e., values smaller than 1 and possibly close to 0) indicate a good damping effect.

Curve A refers to a traditional Helmholtz damper (for example a Helmholtz damper like the one shown in FIG. 1); it is clear from curve A that the damping bandwidth is very narrow.

Curve B refers to an arrangement of two Helmholtz dampers, whose resonance frequency is switched far apart, connected in series. It is clear from curve B that the damping bandwidth has two narrow damping areas (each area astride of the resonance frequency of one Helmholtz damper).

Curve C refers to an arrangement like the one of FIG. 2, with two Helmholtz dampers, whose resonance frequencies are close one to the other to have a damping synergic effect, connected in series.

It is clear from curve C that instead of two narrow damping areas, in the case of a synergic effect, the bandwidth has one damping area that is much larger than without a synergic effect.

Figure 9:
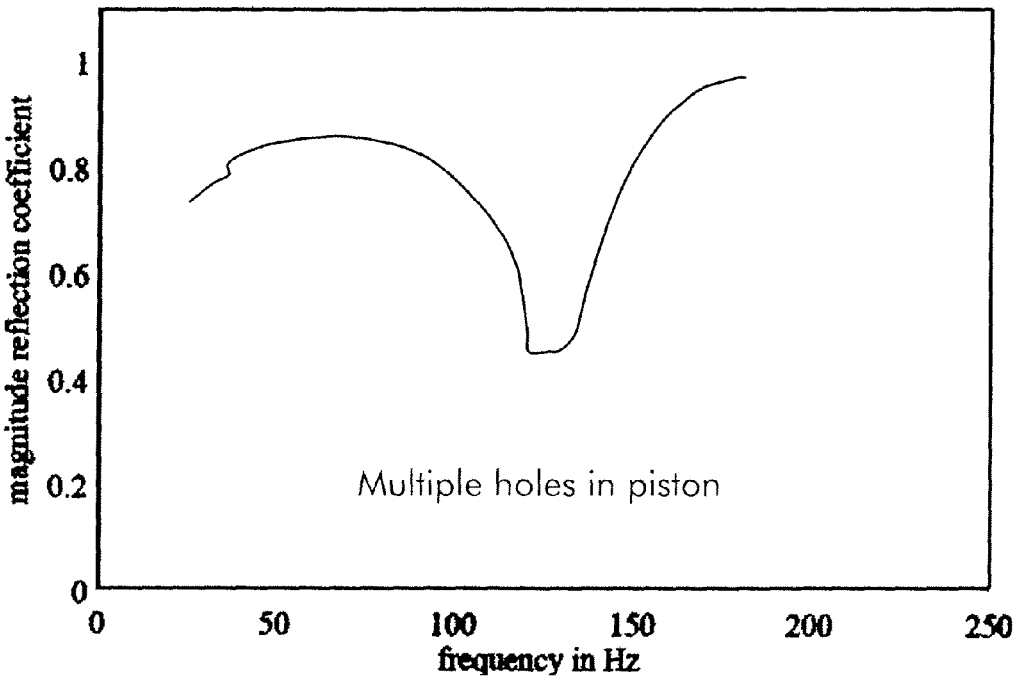

FIG. 9 shows a diagram drafted when testing an arrangement like the one of FIG. 3. Also in this case it is clear that the damping bandwidth is very large, in particular when compared to the bandwidth of an arrangement of Helmholtz damper connected in series.

Naturally the features described may be independently provided from one another.

In practice the materials used and the dimensions can be chosen at will according to requirements and to the state of the art.

REFERENCE NUMBERS

1 traditional Helmholtz damper
2 enclosure
3 resonator volume
4 neck
5 combustion chamber
6 wall of 5
10 arrangement
11 first Helmholtz damper
12 second Helmholtz damper
13 volume of 12
14 neck of 12
15 combustion chamber
16 volume of 11
17 neck of 11
17*a*, 17*b*, 17*c* necks
20 cylinder
21 piston
21*a*, 21*b* piston
24 entrance for cooling air
25 rod
26 intermediate volume
28*a*, 28*b* rod
29 actuator
30 control unit
31 sensor
33, 34 pieces of 21
35, 36 holes of 33, 34
A reflection coefficient of a traditional Helmholtz damper
B reflection coefficient of a traditional arrangement of Helmholtz dampers
C reflection coefficient of an arrangement of Helmholtz dampers in an embodiment of the invention
F movement of 25

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A damper arrangement comprising:

first and second Helmholtz dampers, the first Helmholtz damper being connected in series to the second Helmholtz damper;

wherein resonance frequencies of the first Helmholtz damper and the second Helmholtz damper are close to one another such that they are shifted from one another in an amount producing a synergistic damping effect;

wherein the bandwidth of the combined first and second Helmholtz dampers has one damping area that is larger than that of the bandwidths of first and second Helmholtz dampers without said synergistic effect;

wherein the second Helmholtz damper has a second volume and a second neck connectable to the inside of a chamber in which pressure pulsations to be damped may occur; and wherein the first Helmholtz damper comprises an entrance for cooling air.

2. A damper arrangement as claimed in claim 1, wherein:

the second Helmholtz damper has a second volume and a second neck connectable to the inside chamber in which pressure pulsations to be damped may occur;

the first Helmholtz damper has a first volume and a first neck connected to the second volume; and the first Helmholtz damper, the second Helmholtz damper, or both are configured and arranged so that the first volume, the second volume, or both are variable volumes.

3. A damper arrangement as claimed in claim 2, further comprising:

a cylinder and at least one slidable piston, the cylinder housing the at least one slidable piston;

wherein the cylinder and the at least one slidable piston define the first volume at a first side of the at least one slidable piston and the second volume at a second side of the at least one slidable piston; and wherein the at least one slidable piston defines the first neck.

4. A damper arrangement as claimed in claim 3, further comprising:

an actuator, said at least one slidable piston being connected to the actuator to adjust a position of the at least one slidable piston;

pressure pulsation sensors; and a control unit in control communication with the actuator and in signal communication with the pressure pulsation sensors, wherein the actuator is driven by the control unit.

5. A damper arrangement as claimed in claim 4, wherein the first neck has a variable cross section.

6. A damper arrangement as claimed in claim 5, wherein:

the at least one slidable piston comprises two pieces slidable one over the other, the two pieces comprising alignable holes; and further comprising a plurality of first necks with variable cross sections defined by the alignable holes in the two pieces.

7. A damper arrangement as claimed in claim 1, wherein the resonance frequencies ($\omega_1$-$\omega_2$) of the Helmholtz dampers satisfy the relationship.

$$(\omega_1-\omega_2)^2/(\omega_{1\ \omega 2})\leq 1.$$

8. A damper arrangement as claimed in claim 1, wherein the resonance frequencies ($\omega_1$-$\omega_2$) of the Helmholtz dampers satisfy the relationship $$CL=(\omega_1-\omega_2)^2/(\omega_{1\ \omega 2})<<1,$$

wherein CL<<1 is at least one order of magnitude lower than 1.

9. A damper arrangement as claimed in claim 1, wherein damping occurs in the frequency range between the shifted the resonance frequencies of the first Helmholtz damper and the second Helmholtz damper.

10. A damper arrangement as claimed in claim 1, wherein a broadband character is adjusted by the flow velocity inside the first neck, wherein the broadband characteristic depends on a non-dimensional value $$q=(w_0\cdot L_N)/(\xi\cdot u_N)$$

larger than 0.1, wherein $w_0$ is the arithmetic mean of the single frequencies of the single dampers, $L_N$ is the length of the first neck, □ is the loss coefficient of the first neck, and $u_N$ is the flow velocity inside the first neck.

11. A method for designing a damper arrangement having at least a first Helmholtz damper connected in series to a second Helmholtz damper, the method comprising:

providing at least first and second Helmholtz dampers connected in series, the first and second Helmholtz dampers having resonance frequencies which are close to each other; and shifting the resonance frequency of the first Helmholtz damper and the resonance frequency of the second Helmhotz damper, one with respect to the another, until their displacement produces a synergistic damping effect, wherein the bandwidth of the combined first and second Helmholtz dampers has one damping area that is larger than that of the bandwidths of first and second Helmholtz dampers without said synergistic effect, wherein the second Helmholtz damper has a second volume and a second neck connectable to the inside of a chamber in which pressure pulsations to be damped may occur, and wherein the first Helmholtz damper comprises an entrance for cooling air.

12. A method as claimed in claim 11 wherein shifting comprises:

regulating a first volume and/or a second volume of the first and second Helmholtz damper, respectively, or;

regulating a first cross section neck between the first and second Helmholtz damper; or both.

13. A method as claimed in claim 11, comprising:

adjusting a broadband character by the flow velocity inside the first neck, wherein the broadband characteristic depends on a non-dimensional value $$q=(w_0\cdot L_N)/(\xi\cdot u_N)$$

larger than 0.1, wherein $\omega_0$ is the arithmetic mean of the single frequencies of the single dampers, $L_N$ is the length of the first neck, □ is the loss coefficient of the first neck, and $u_N$ is the flow velocity inside the first neck.

14. A method for damping pulsations with a damper arrangement, wherein the damper arrangement comprises first and second Helmholtz dampers, the first Helmholtz damper being connected in series to the second Helmholtz damper, wherein resonance frequencies of the first Helmholtz damper and the second Helmholtz damper are close to one another, wherein the second Helmholtz damper has a second volume and a second neck connectable to the inside of a chamber in which pressure pulsations to be damped may occur, wherein the first Helmholtz damper comprises an entrance for cooling air, wherein the method comprises feeding cooling air to the first Helmholtz damper such that the frequencies of the first and second Helmholtz dampers are shifted from one another in an amount producing a synergistic damping effect, and wherein the bandwidth of the combined first and second Helmholtz dampers has one damping area that is larger than that of the bandwidths of first and second Helmholtz dampers without the synergistic effect.

* * * * *